US008272521B1

(12) United States Patent
Kemmerly et al.

(10) Patent No.: US 8,272,521 B1
(45) Date of Patent: Sep. 25, 2012

(54) CRANE MOMENT LOAD AND LOAD DELIVERY SYSTEM CONTROL AND METHOD

(75) Inventors: Nathan T. Kemmerly, Bixby, OK (US); Michael J. Lawson, Jenks, OK (US); Mark K. Torbett, Big Bend, WI (US); Mark A. Smith, Waterford, WI (US)

(73) Assignee: Auto Crane Company, Tulsa, OK (US)

( * ) Notice: Subject to any disclaimer, the term of this patent is extended or adjusted under 35 U.S.C. 154(b) by 537 days.

(21) Appl. No.: 12/573,550

(22) Filed: Oct. 5, 2009

(51) Int. Cl.
*B66C 13/16* (2006.01)

(52) U.S. Cl. ..... 212/278; 212/280

(58) Field of Classification Search ..... 212/277, 212/278, 280
See application file for complete search history.

(56) References Cited

U.S. PATENT DOCUMENTS 4,178,591 A * 12/1979 Geppert ..... 340/685
4,185,280 A * 1/1980 Wilhelm ..... 212/278
4,216,868 A * 8/1980 Geppert ..... 212/278
4,395,706 A * 7/1983 Garber ..... 340/685
4,787,524 A * 11/1988 Cobb et al. ..... 212/278
4,815,614 A * 3/1989 Putkonen et al. ..... 212/272
4,861,224 A * 8/1989 Holmes ..... 414/680
5,160,055 A * 11/1992 Gray ..... 212/278
5,359,516 A * 10/1994 Anderson ..... 701/50
6,170,681 B1 * 1/2001 Yoshimatsu ..... 212/278
6,378,653 B1 * 4/2002 Takahashi ..... 182/69.4
6,553,278 B2 * 4/2003 Handroos et al. ..... 700/213
6,718,245 B2 * 4/2004 Watanabe et al. ..... 701/50
6,785,597 B1 * 8/2004 Farber et al. ..... 701/50
6,994,223 B1 2/2006 Edgar, II et al.
7,677,401 B2 * 3/2010 Rudy ..... 212/270

* cited by examiner

*Primary Examiner* — Emmanuel M Marcelo
(74) *Attorney, Agent, or Firm* — Gable Gotwals

(57) ABSTRACT

The present invention is a crane operating system and method which monitors the crane moment load in order to keep the crane within the safe operating envelope. In determining the current crane moment load the system considers boom raising cylinder pressure, boom angle, chassis incline, as well as hydraulic pressure.

13 Claims, 3 Drawing Sheets

CRANE MOMENT LOAD AND LOAD DELIVERY SYSTEM CONTROL AND METHOD

REFERENCE TO PENDING APPLICATIONS

This application is not based upon any pending domestic or international patent applications.

REFERENCE TO MICROFICHE APPENDIX

This application is not referenced in any microfiche appendix.

FIELD OF THE INVENTION

The present invention is generally directed toward a crane control system and method. More specifically, the present invention is a crane control system and method which restricts operation of the crane for safety purposes based on the crane moment load.

BACKGROUND OF THE INVENTION

Cranes are commonly used to lift heavy objects in various types of construction projects. Many of these cranes are mounted on a chassis or vehicle of some type. These cranes typically have a boom mounted to a rotatable base. Often times the boom is telescopic and can be extended and retracted. Similarly the boom can be raised and lowered by increasing or decreasing the angle between the boom and that of the base.

One of the most common hazards of operation of such a crane is lifting too large of a load. Often times it is not the actual weight of the load being lifted that causes the failure. It is that the load being lifted is at a distance too far from the base.

An example of this might be a load that is initially lifted from adjacent the chassis of the crane. Once lifted, the crane then booms out or lowers the boom, causing the load to move out away from the base of the crane. At the same time the operator may extend the telescoping boom thus adding to the distance between the load and the base of the boom. While the weight of the load in this example remains constant, the moment created by the load increases as the distance between the load and the base of the boom increases. At the point this crane moment load exceeds that of what the crane is designed to handle, the crane will roll over presenting the possibility of damage to the load as well as damaging surrounding structures and injuring nearby workers.

While accidents like this occur regularly, prior attempts to implement safeguards have been limited to crane operating systems which monitor the weight of the load or hydraulic system pressure created by the load. This is a key variable in the problem. However as can be seen by the example above, what begins as a lift which is well within the capacity of the crane can have devastating results when the load is moved too far away from the boom base.

Another key variable that can drastically impact the safe working radius of the crane is the incline of the surface supporting the crane chassis and in turn the incline of the chassis itself. A slight gentle incline can have a profound effect on the safe operating radius of the crane. Often times these inclines go unnoticed by the crane operator.

Therefore what is needed is a crane operating system which monitors the operational variables of the crane that effect the crane moment load and vehicle stability.

Further what is needed is a crane operating system which monitors the crane moment load in combination with the ability to restrict the operation of the crane to movements within its capacity.

Additionally what is needed is a crane operating system which considers such factors as boom rotation and inclination, outrigger location, chassis incline and boom raising cylinder hydraulic pressure in keeping the crane within the safe operating envelope.

BRIEF SUMMARY OF THE INVENTION

The present invention is a crane operating system and method which monitors the crane moment load in order to keep the crane within the safe operating envelope. In determining the current crane moment load the system considers boom raising cylinder pressure, boom angle, chassis incline, location of the outriggers as well as hydraulic pressure.

Certain versions of the present invention include setting three or more ranges of crane moment load operation. The first being a normal operating position which allows operation of the crane by the crane operator without modification. The second and third ranges being near the limit or outside the safe operating envelope of the crane with restrictions on control of the operation of the crane.

A further feature of one embodiment of the present invention is the use of a tri-axis inclinometer having a master two-axis inclinometer in connection with a slave single-axis inclinometer. The two-axis inclinometer is mounted to the base of the crane or the chassis. It senses the incline of the chassis in two perpendicular directions. The slave inclinometer is attached to the boom and senses the boom angle. This information is then passed along to a processing unit to be considered in calculating the crane's moment load.

BRIEF DESCRIPTION OF THE DRAWINGS

Preferred embodiments of the invention will now be described in further detail. Other features, aspects, and advantages of the present invention will become better understood with regard to the following detailed description, appended claims, and accompanying drawings (which are not to scale) where:

DETAILED DESCRIPTION OF THE PREFERRED EMBODIMENT(S)

Figure 1:
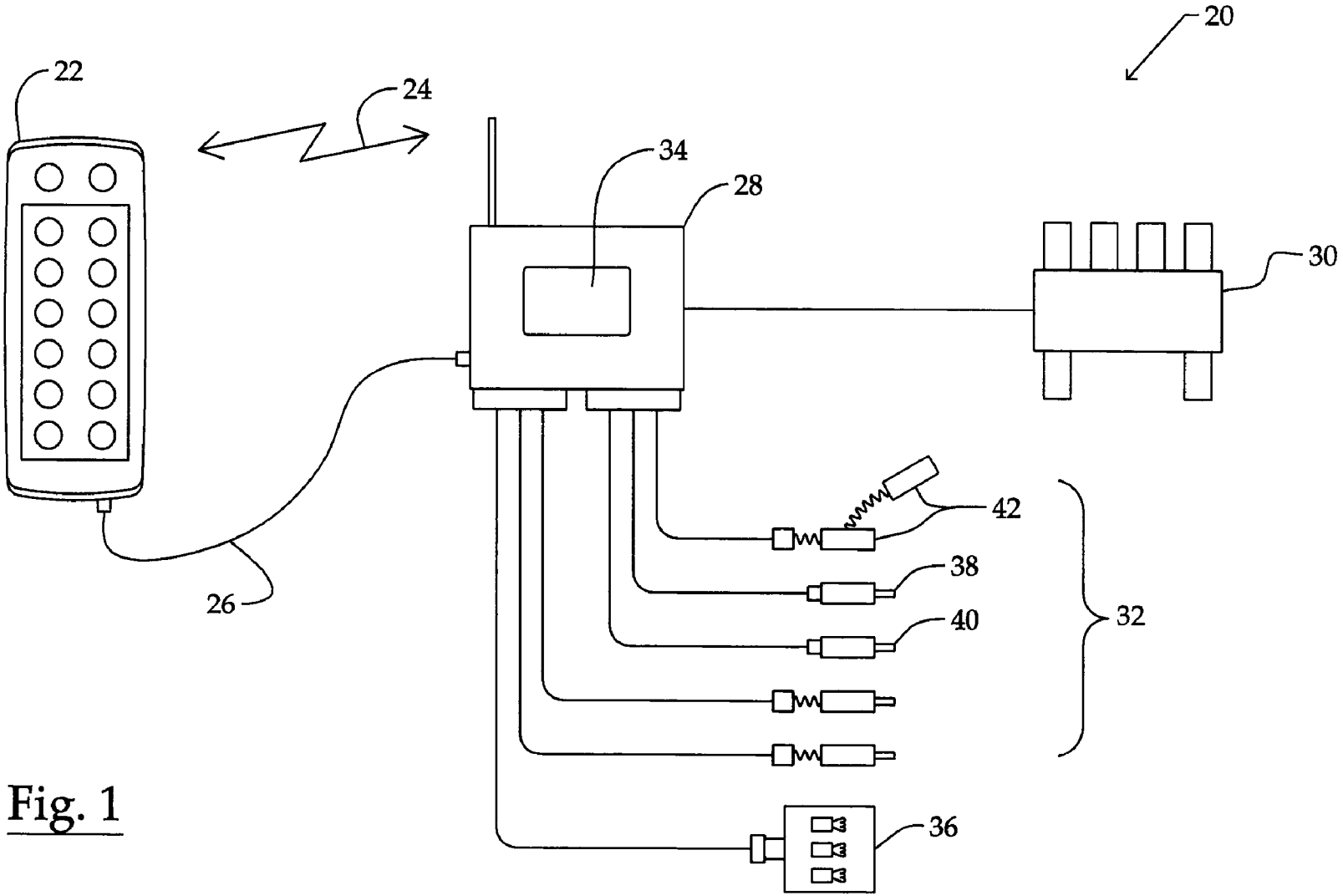
FIG. 1 is a schematic drawing of the crane control system of the present invention.

Turning now to FIG. 1, the crane control system 20 has a handheld controller 22 which can be connected either wirelessly 24 or via a wire connection 26 to the processing unit 28. The processing unit 28 receives operator commands from the handheld controller 22 either wirelessly or via the wire connection. The processing unit 28 also receives information regarding the operating condition of the crane via a plurality of inputs 32. The processing unit 28 controls operation of the crane via a proportional hydraulic control valve 30 which is used to provide hydraulic fluid to various hydraulic motors and hydraulic cylinders operating the crane. The processing unit 28 can also be equipped with a digital display 34 used to provide information to the crane operator. Similarly the processing unit 28 can be equipped with various warning devices 36, such as warning lights and/or warning buzzers or horns.

The crane control system 20 of the present invention maintains a safe operating environment for the crane by periodically calculating the crane moment load. If the crane moment load becomes excessive, a collapse or rollover of the crane can occur causing injury to nearby workers as well as lost time on the construction project and damage to the crane and surrounding structures. The input devices 32 include a crane slewing pressure transducer 38, a boom raising pressure transducer 40, boom and chassis inclination sensors 42.

The amount of the load being lifted by the crane can be approximated by the hydraulic systems pressure from the boom raising cylinder pressure transducer. It is then sent to the processing unit 28.

Figure 3:
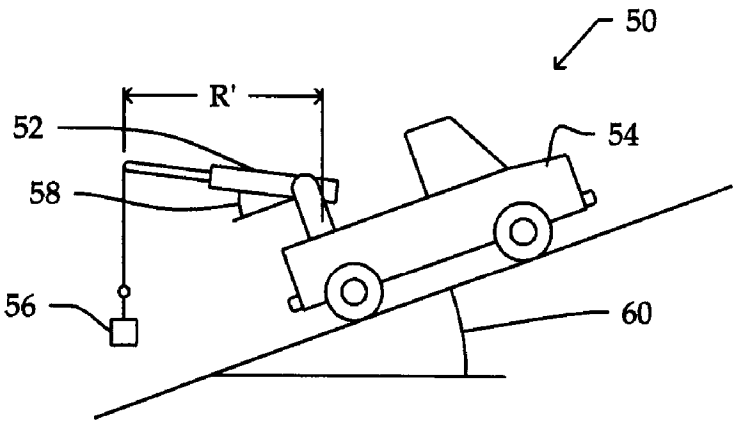
FIG. 3 is a diagram illustrating the effect of incline of the crane chassis on crane moment load.
Figure 2:
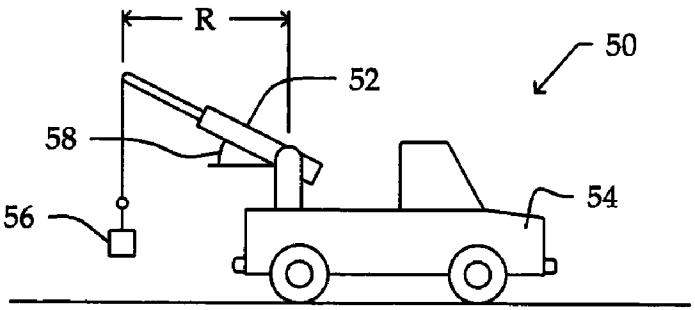
FIG. 2 is a diagram illustrating the relationship of boom inclination and crane moment load.
Figure 4:
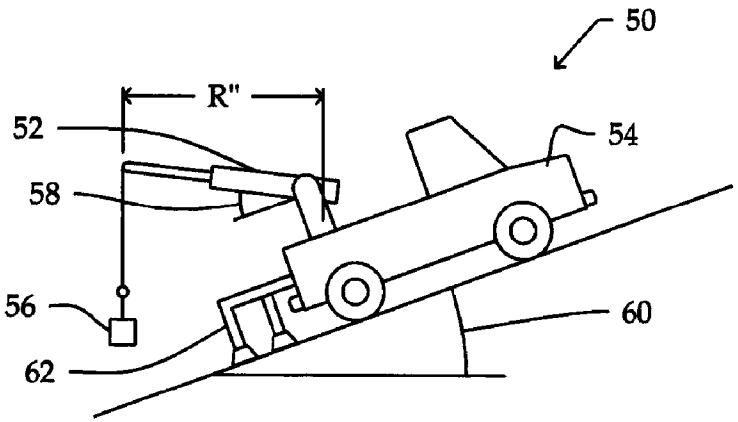
FIG. 4 is a diagram illustrating the benefits of use of outriggers on the vehicle stability.

We turn now to FIGS. 2, 3 and 4 which illustrate the effect incline and use of outriggers has on crane moment load. FIG. 2 shows a crane 50 located upon a flat level surface. The crane 50 has a boom 52 mounted on a chassis 54. The crane 50 is being used to lift a load 56. The boom angle is indicated by element number 58.

Crane moment load is determined by the weight of the load 56 times the working radius R of the crane 50 at the time the load 56 is being lifted. When the crane 50 is on a level surface the crane moment load can be increased by either increasing the radius R or the weight of the load 56. The radius R can be increased by lengthening the boom 52. Likewise as the boom angle 58 decreases the crane moment load increases. Conversely the crane moment load can be decreased by decreasing the amount of the load 56, shortening the length of the boom 52 or increasing the boom angle 58.

Turning now to FIG. 3 the crane 50 is located on an incline with an incline angle 60. The boom angle 58 is the same as that shown in FIG. 2 however because of the incline angle 60 the working radius R' is longer than the radius R shown in FIG. 2. This occurs because the load 56 can only exert a force in the downward vertical direction. As the crane chassis 54 is inclined upward the actual horizontal reach of the boom 52 increases. Thus the working radius R' in FIG. 3 is increased to be larger than that of the original working radius R shown in FIG. 2.

Turning now to FIG. 4 the crane 50 is equipped with outriggers 62. The outriggers 62 help provide a more stable platform for the crane 50. The boom angle 58 in FIG. 4 is the same as that illustrated in FIGS. 2 and 3. The incline angle 60 is the same in FIG. 4 as it is in FIG. 3.

With the outrigger 62 deployed and the boom 52 lifting over the deployed outrigger 62, the working radius R" is less than that of the crane 50 shown in FIG. 3 without outriggers. Thus the crane moment load in FIG. 4 is decreased over that shown in FIG. 3 due to the shortening of the working radius R".

It should be noted the orientation of the boom 52 as it rotates about its base 64 can also have an effect on the working radius. If the boom 52 is extended out over the outriggers 62, the outriggers 62 have a greater effect of reducing the working radius R of the crane 50. Similarly if the boom 52 is extended perpendicular to the direction of the outriggers 62, the effect of the outriggers 62 in reducing the working radius R and in turn the crane moment load can be drastically reduced. Thus it can be beneficial to consider the rotational orientation of the boom 52 when calculating the crane moment load.

We turn now to the operation of the crane control system 20 of the present invention. The processing unit 28 of the present invention is typically mounted on an external portion of the crane or chassis where the digital display 34 can be visible to an operator during use. Upon installation the processor 28 is programmed with information related to various characteristics of the crane 50. These characteristics include but are not limited to range of boom length, range of outriggers and their location relative to the base 64 of the boom 52, location of boom base 64 relative to the wheels or tracks of the chassis 54, range of boom angle 58 and range of incline angle 60.

Because the incline can vary both along the length of the truck as well as from side to side of the truck, ideally there are two incline angles in an X and a Y horizontal direction. These X and Y directions are perpendicular. They can be set either relative to the chassis or relative to the base 64 of the boom 52.

A plurality of boom raising cylinder pressure ranges and boom inclination angle ranges are stored in the processing unit 28. In the preferred embodiment there are three ranges that are entered. A first range in which the operation of the crane 50 by the operator is unrestrictive. A second range wherein the operation of the crane 50 is restricted and a third range where the operation of the crane 50 is further restricted. The warning devices 36 and/or the digital display 34 can be used to communicate to the operator the current crane moment load or the range in which it falls.

In the second range the control for the processing unit 28 can modify the crane operation by using the proportional valve 30 to reduce the hydraulic fluid flow to slow movements of the crane 50. This can include but is not limited to modifying the speed at which the boom 52 is raised, lowered, extended or retracted. Likewise the speed at which the boom 52 is rotated can also be restricted.

When the crane 50 is being operated and the crane moment load is in the third range, the processing unit 28 can be used to slow or completely eliminate certain operations of the crane 50. Those operations that would further increase the crane moment load could be eliminated completely while those operations of the crane which would decrease the crane moment load can be allowed and/or slowed. Those operations which typically reduce the crane moment load include retracting the boom 52, raising the boom 52, and lowering the load to the ground.

When the crane 50 is in use the control system 20 accepts commands from the operator from the handheld controller 22. The commands are transmitted either wirelessly or via a wire to the processing unit 28. The processing unit 28 then sends a signal to a proportional hydraulic control valve 30 to control the flow of hydraulic fluid to the various hydraulic motors and cylinders on the crane 50. In the preferred embodiment a pulse width modulated signal is used. The control system periodically obtains information from the input devices 32 on the crane 50. These include but are not limited to hydraulic operating pressure, crane slewing pressure, boom raising cylinder pressure, boom angle, incline angle in the X direction, incline angle in the Y direction, and outrigger location. It then uses this information to calculate the crane moment load. At that point in time as long as the crane moment load is within the first range, the operation of the crane by the operator is unrestricted except for certain basic safeguards which might be programmed in. If the crane moment load falls within the second range the operation of the crane can be modified to provide safeguards. These modifications can include those limitations discussed above. Likewise if the crane moment load falls within the third range, the operation of the crane can be modified as further discussed above.

Figure 5:
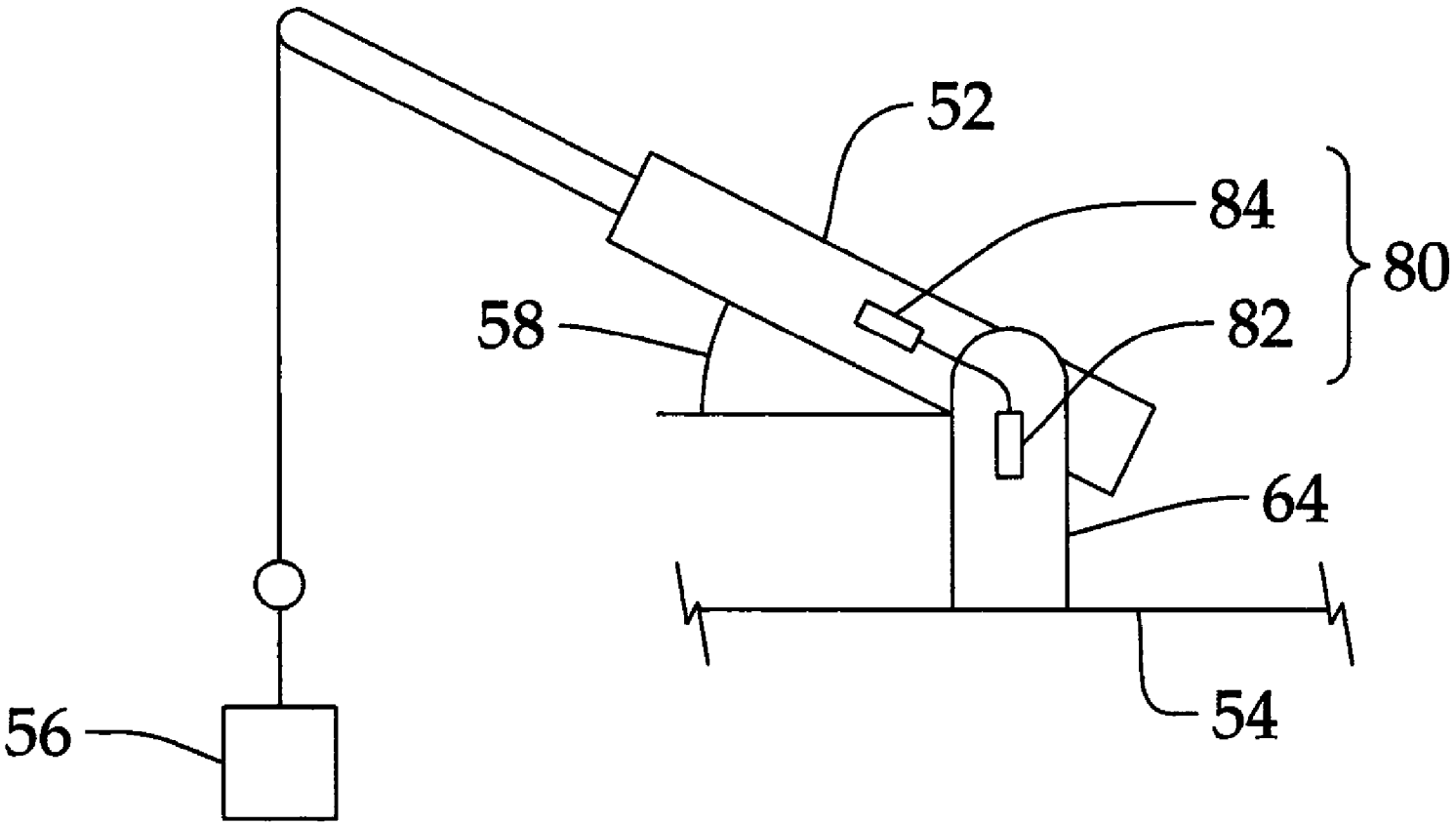
FIG. 5 is a schematic diagram illustrating the tri-axis inclinometer.

In the preferred embodiment as seen in FIG. 5 information regarding the boom angle 58 and the inclines angle 60 in an X and a Y direction are obtained using a tri-axis inclinometer 80. The tri-axis inclinometer 80 has a master two-axis inclinometer 82 connected to a slave single axis inclinometer 84. The master 82 is mounted to the crane base 64 and senses incline in an X and Y direction. These directions typically are perpendicular to one another. The slave 84 is mounted to the crane boom 52. The slave 84 senses the boom angle 58. This boom angle 58 information is sent to the master 82 which calculates the actual boom angle 58 relative to the boom base 64. This information is then transmitted to the processing unit 28.

The foregoing description details certain preferred embodiments of the present invention and describes the best mode contemplated. It will be appreciated, however, that changes may be made in the details of construction and the configuration of components without departing from the spirit and scope of the disclosure. Therefore, the description provided herein is to be considered exemplary, rather than limiting, and the true scope of the invention is that defined by the following claims and the full range of equivalency to which each element thereof is entitled.

What is claimed is:

1. A method for controlling the operation of a crane, comprising the steps of:

providing operator controls to allow control of the crane operations by an operator;

using a proportional hydraulic valve to independently control hydraulic fluid coupled to hydraulic motors that control the crane operations;

periodically monitoring by a control system a hydraulic crane moment load of a lift mechanism of the crane so as to determine a moment load condition of the crane;

periodically monitoring by the control system of a boom raising cylinder pressure and boom inclination;

periodically monitoring by the control system of the level of a crane chassis;

periodically calculating a crane moment load based on the hydraulic boom raising cylinder pressure, boom inclination and crane level;

storing in the control system a plurality of ranges of boom raising cylinder pressure and boom inclination angle applied to the lift mechanism during various crane operations, including; a) a first range of crane moment load and, b) a second range of crane moment load, said second range being higher than said first range, and c) a third range of crane moment load, said third range being higher than said second crane moment load range;

allowing the crane to be operated by the operator without modification when the crane moment load is in said first range; using the control system to modify crane operations requested by the operator when the crane moment load is in said second crane moment load range, including using the control system to control the proportional valve to reduce the hydraulic fluid flow therethrough to slow the movements of the crane operations; and using the control system to deny various crane operations requested by the operator when the crane moment load is in said third crane moment load range, said various crane operations being denied comprise those crane operations which would increase a moment of a load being lifted by the crane, and said control system allows other crane operations not having an effect of increasing the moment to be carried out when the crane moment load is in said third crane moment load range.

2. The method of claim 1, said using a proportional hydraulic valve operation comprises controlling the valve with pulse width modulation of a control signal.

3. The method of claim 1, further comprising:

periodically monitoring by the control system of deployment of an outrigger; and using deployment of the outrigger in determining the operational mode of the crane.

4. The method of claim 1, further comprising:

periodically monitoring by the control system of inclination of a boom; and using inclination of the boom in calculating the crane moment load.

5. The method of claim 1, further comprising:

periodically monitoring by the control system of the raising cylinder pressure of the boom; and using the raising cylinder pressure of the boom in calculating the crane moment load.

6. The method of claim 1, wherein said third crane moment load range comprises an overload range, and further including allowing the operator to raise a boom of the crane, or retract a telescopic boom of the crane or lower the load when the crane moment load is in said third crane moment load range.

7. The method of claim 1, further comprising:

providing a hydraulic valve for controlling a movement of each crane apparatus, and supplying pressurized fluid to said hydraulic valves by way of said proportional valve.

8. The method of claim 1, further comprising:

modifying crane operations requested by the operator when the crane moment load is in said second crane moment load range by modifying the requested speed by which a boom of the crane is lowered.

9. The method of claim 1, further comprising:

providing visual readout indications of different operating conditions of the crane as a function of the crane moment load.

10. The method of claim 9, further comprising:

providing a visual readout of an overload condition of the crane when the hydraulic crane moment load is monitored and determined by said control system as exceeding a predefined threshold.

11. The method of claim 10, further comprising:

monitoring crane moment load; and providing a visual indication when the crane moment load and the overload ranges indicate that the crane operations are in a normal range.

12. The method of claim 1, further comprising:

providing visual readout indications of different operating conditions of the crane as a function of monitored overload ranges of the crane.

13. The method of claim 1, further comprising:

providing a visual display for displaying status codes, said status codes relating to operational parameters of the crane;

providing said visual display on said crane outside a cab of the crane so as to be visible by an operator using a wireless hand-held transmitter for controlling operation of the crane; and said visual display associated with a listing of the status codes cross-referenced to problems related to a crane operation or crane moment load condition.

* * * * *